US005769799A

United States Patent [19]

Daughtry

[11] Patent Number: 5,769,799

[45] Date of Patent: Jun. 23, 1998

[54] MASSAGING SUPPORT CHAIR WITH POWERED ROLLERS IN BACK AND SEAT SUPPORT

[76] Inventor: Dallas K. Daughtry, 6931 Leslie Rd., San Antonio, Tex. 78254

[21] Appl. No.: 781,778

[22] Filed: Jan. 9, 1997

[51] Int. Cl.[6] ..... A61H 15/00

[52] U.S. Cl. ..... 601/115; 601/126; 601/122

[58] Field of Search ..... 601/50, 52, 24, 601/26, 49, 122, 126–8, 130, 86, 87, 90, 91, 93, 94, 99, 102, 111, 115

[56] References Cited

U.S. PATENT DOCUMENTS

| | | | |
|---|---|---|---|
| 1,322,720 | 11/1919 | Noble . | |
| 2,359,933 | 10/1944 | Niblack . | |
| 2,577,646 | 12/1951 | Cameron | 601/115 X |
| 2,593,982 | 4/1952 | Cash | 601/122 |
| 2,840,072 | 6/1958 | Stearns | 601/115 |
| 3,050,050 | 8/1962 | Kubicek . | |
| 3,322,116 | 5/1967 | Murphy et al. . | |
| 3,881,469 | 5/1975 | Kanemitsu | 601/115 X |
| 4,011,962 | 3/1977 | Kosiak . | |
| 4,154,232 | 5/1979 | Fukazawa | 601/122 X |
| 4,422,449 | 12/1983 | Hamabe . | |
| 4,576,149 | 3/1986 | Otuka et al. . | |
| 5,233,973 | 8/1993 | Gill et al. . | |
| 5,251,615 | 10/1993 | Sheen . | |

FOREIGN PATENT DOCUMENTS

| | | | |
|---|---|---|---|
| 2157949 | 11/1985 | United Kingdom | 601/94 |

*Primary Examiner*—Danton D. DeMille

*Attorney, Agent, or Firm*—Miller, Sisson, Chapman & Nash, P.C.

[57] ABSTRACT

A massaging support device for a body has two separately controllable massaging zones. A plurality of generally cylindrical rollers extend transversely across first and second support frames and are arranged in substantially parallel relationship. One set of rollers is provided with a central circumferential depression to align with the spine of the body when cradled in or on the support device. The rollers are provided with eccentric journals which cause the rollers to raise and lower against the body during rotation. By controlling the speed and direction of the roller rotation enhanced massaging is achieved.

5 Claims, 3 Drawing Sheets

MASSAGING SUPPORT CHAIR WITH POWERED ROLLERS IN BACK AND SEAT SUPPORT

BACKGROUND OF THE INVENTION

This invention relates to wheelchairs and other supports. More particularly, the invention relates to supports having a mechanism for massaging the body of one positioned on the support surface.

The prior art teaches numerous devices which both support and massage the occupant. The following is a listing of patents granted on such devices: U.S. Pat. Nos. 1,322,720; 2,359,933; 3,050,050; 3,322,116; 4,011,862; 4,422,449; 4,576,149; 5,233,973; and 5,251,615.

When a patient is confined to a bed or chair, he is likely to develop sores on those portions of his body which are in constant contact and under compression against the bed or chair surface. The potential of developing such sores may be significantly diminished by increasing the circulation of capillary blood flow through those areas supporting the patient's weight. Many of the devices shown in the prior art teach the use of rollers under the patient supporting surface of beds and chairs.

However, the prior art principally teaches or discloses the simple rotation of the rollers against the body. In some cases the rollers move along a track or on an endless belt. The rollers all rotate in the same direction and at the same speed or rate. No provision is made for reducing the massaging action along the patient's spine. Thus, the advantages of increasing blood circulation with the prior art devices creates a painful condition along the spine because it is not covered by much fat or muscle. The unique arrangement of the elements of the present invention overcome these problems of the prior art.

SUMMARY OF THE INVENTION

The present invention increases the capillary blood flow by having the full length of the rollers rotate about an eccentric journal thereby causing the rollers to continuously vary the pressure against the patient's body. The rotation about the eccentric journal causes the entire roller to raise and lower the surface of the roller urging against the patient's body. Further, the present invention provides a central, circumferential depression in the rollers urging against the patient's back. This feature avoids the painful condition of massage against the spine.

Two separate drive systems in the present invention allow the direction and speed of the rollers to be varied over two areas of the support device. It has been found that a slower, more gentle, massaging action is necessary along the seat support than along the back support. Additionally, by being able to rotate the direction of the rollers in the back support in a direction opposed to the roller rotation in the seat support, the present invention assists in cradling the patient in the chair. The back roller rotation urges the patient in the direction of the seat support while the seat rollers urge the patient in the direction of the back support.

By arranging the timing on the drive gears attached to each of the rollers, the massage pattern may be varied. If it is desired to increase the intensity of massage in a particular portion of the back or seat the eccentric journals of adjacent rollers may be arranged to rise and fall together.

BRIEF DESCRIPTION OF THE DRAWINGS

The invention will be better understood and objects other than those set forth above will become apparent when consideration is given to the following detailed description of the preferred embodiments. Such description makes reference to the annexed drawings wherein.

DETAILED DESCRIPTION OF THE PREFERRED EMBODIMENT

Figure 1:
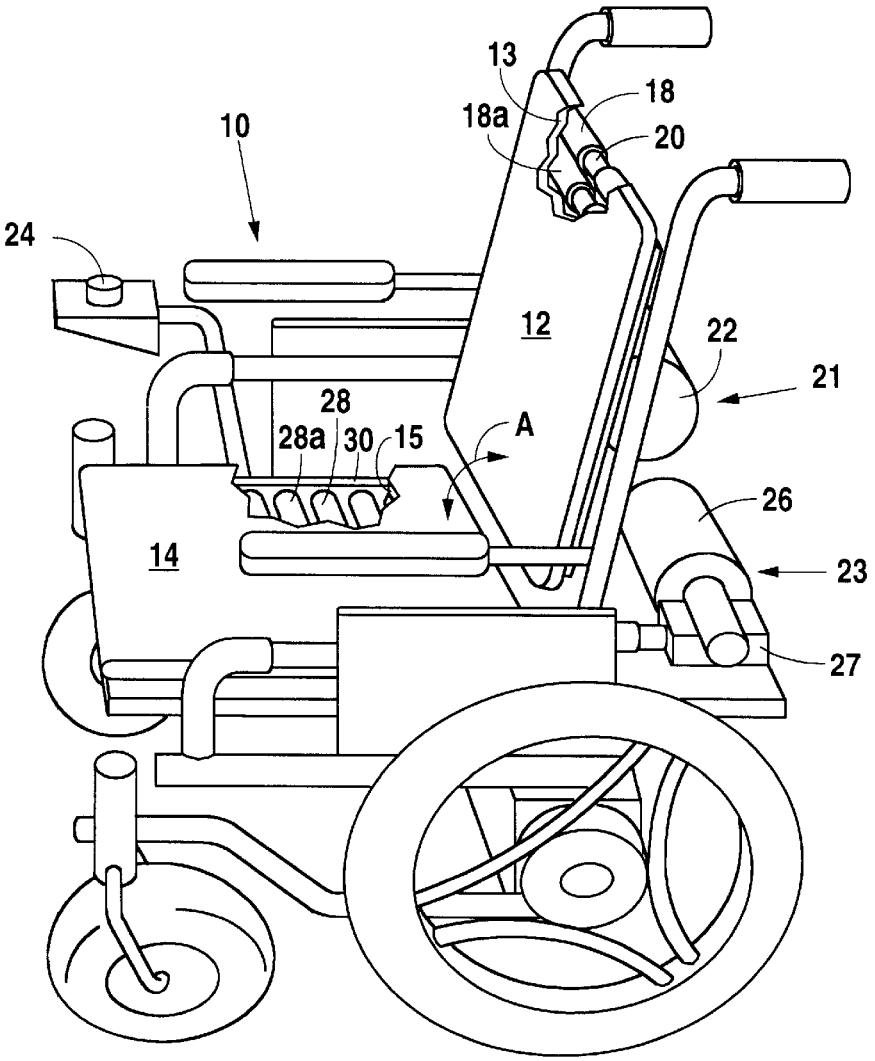
FIG. 1 illustrates a partially exposed perspective view of a wheelchair embodying the present invention.

Turning now in greater detail to the drawings, there is shown in FIG. 1 a wheelchair 10 embodying the massaging support device of the present invention. A back support 12 and a seat support 14 are spaced apart and shown in a generally 80°–90° angular relationship. It should be understood that while the detailed description describes the elements of the present invention in a wheelchair arrangement, the invention may be utilized with any support device such as a bed, chair, cot, table, stretcher and the like. However, in each such arrangement, the device would provide at least two separately controllable massaging support regions or areas. These separate areas may be arranged in any angular configuration. In a chair, the back to seat angle A will be between zero and 90°.

Both the back support 12 and the seat support 14 are provided with thin covers 13 and 15 respectively. Beneath cover 13 is a first support frame 16 (FIG. 2) which holds a plurality of generally cylindrical rollers 18 and 18*a* extending transversely across substantially the entire width of first support frame 16 and arranged in substantially parallel relationship. Each roller 18 and 18*a* is provided with a central, circumferential depression 20. The depression 20 is approximately ⅛" to ¾" deep and 1" to 3" wide. Each depression 20 is in the middle of the roller and aligns with the spine of the body placed in or on the support device.

A driver 21 having a motor 22, and if necessary a gearbox with controls 24, activates the rollers 18 and 18*a*. A second driver 23 having a separate motor 26 and gearbox 27 is also controllable by controls 24 to activate the rollers 28 and 28*a* beneath the cover 15 in the seat support 14. The motors 22 and 26 may be powered by any conventional power source including d.c. batteries, a.c. power, gas or solar energy system.

A second support frame 30 holds a second plurality of generally cylindrical rollers 28 extending transversely across substantially the entire width of second support frame 30 and arranged in substantially parallel relation. In the embodiment shown in FIG. 1, rollers 28 and 28*a* are not provided a central, circumferential depression.

Figure 2:
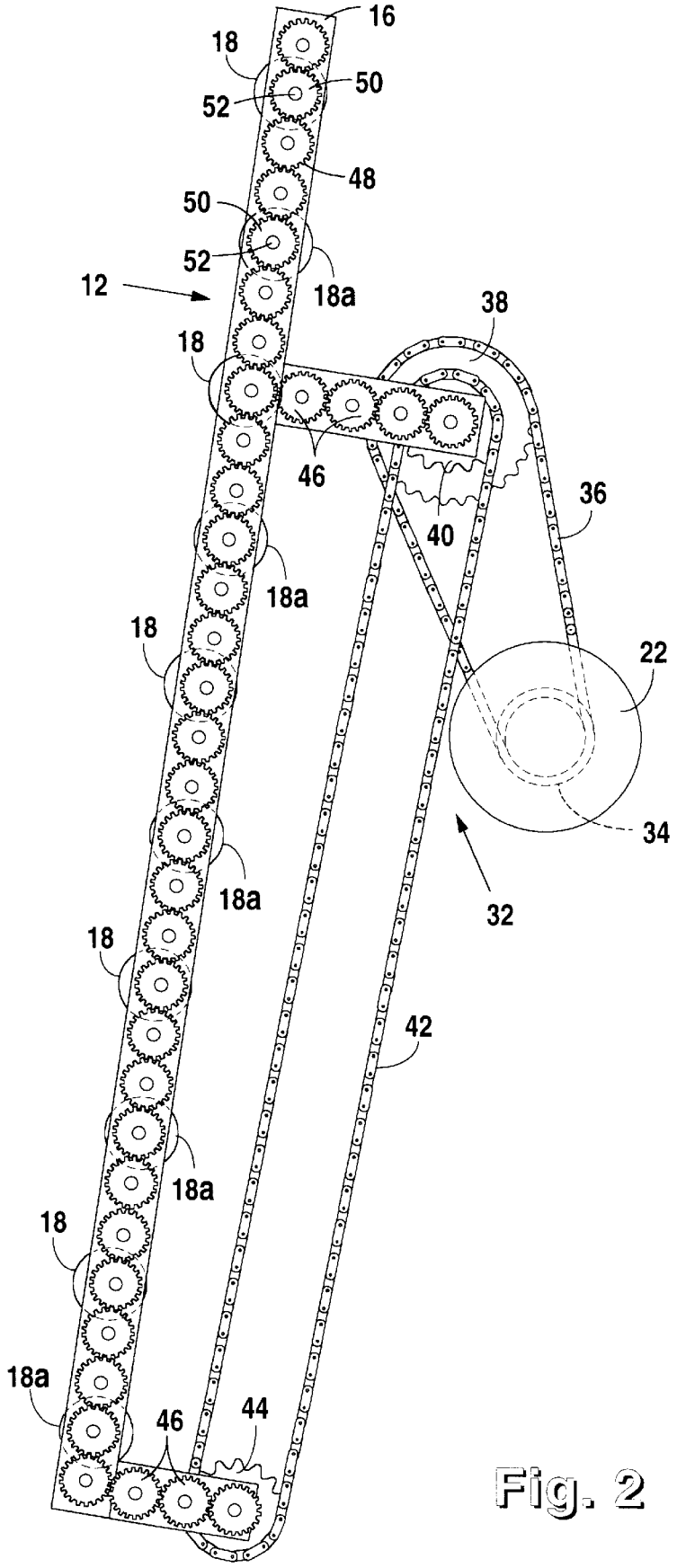
FIG. 2 is a side view of the drive train of a back support of the present invention.

FIG. 2 illustrates a side view of the drive train 32 of a back support 12 embodying the massaging rollers 18 and 18*a* attached to the first support frame 16. Frame 16 is attached to the chair 10 by conventional fasteners (not shown).

Driver system 21 includes the motor 22 and a first drive sprocket 34, chain 36, second sprocket 38, third sprocket 40, second chain 42, idler sprocket 44, and idler gears 46. Frame 16 also provides support for the roller idler gears 48. Each roller 18 or 18*a* is provided with a drive gear 50 attached to the end of the roller journal 52.

When the patient activates the controls 24, motor 22 is activated and drives first drive sprocket 34 which in turn causes the other sprockets 38, 40, 44; the idler gears 46 and 48, the drive gears 50, and rollers 18 and 18*a*, to rotate through the movement of chain 36 and 42. As may be seen in FIGS. 2, 4A and 4B, the end journals 52 on the rollers 18 and 18*a* and 28 and 28*a* are offset from the symmetrical center C of the roller. This eccentric journaling provides for a raising and lower of the contact surface of the rollers under the cover when the rollers rotate in the support frame. In FIG. 2, rollers 18 are "raised" while rollers 18*a* are lowered. By adjusting the degree of rotation of the drive gears 50 during the setup of the drive train 32, it will be understood that the timing of the pattern of the raising and lowering may be varied on each roller. Further, the rate of speed of rotation as well as the direction of rotation of the rollers may be adjusted through the drive train or by varying the motor speed or direction.

Figure 3:
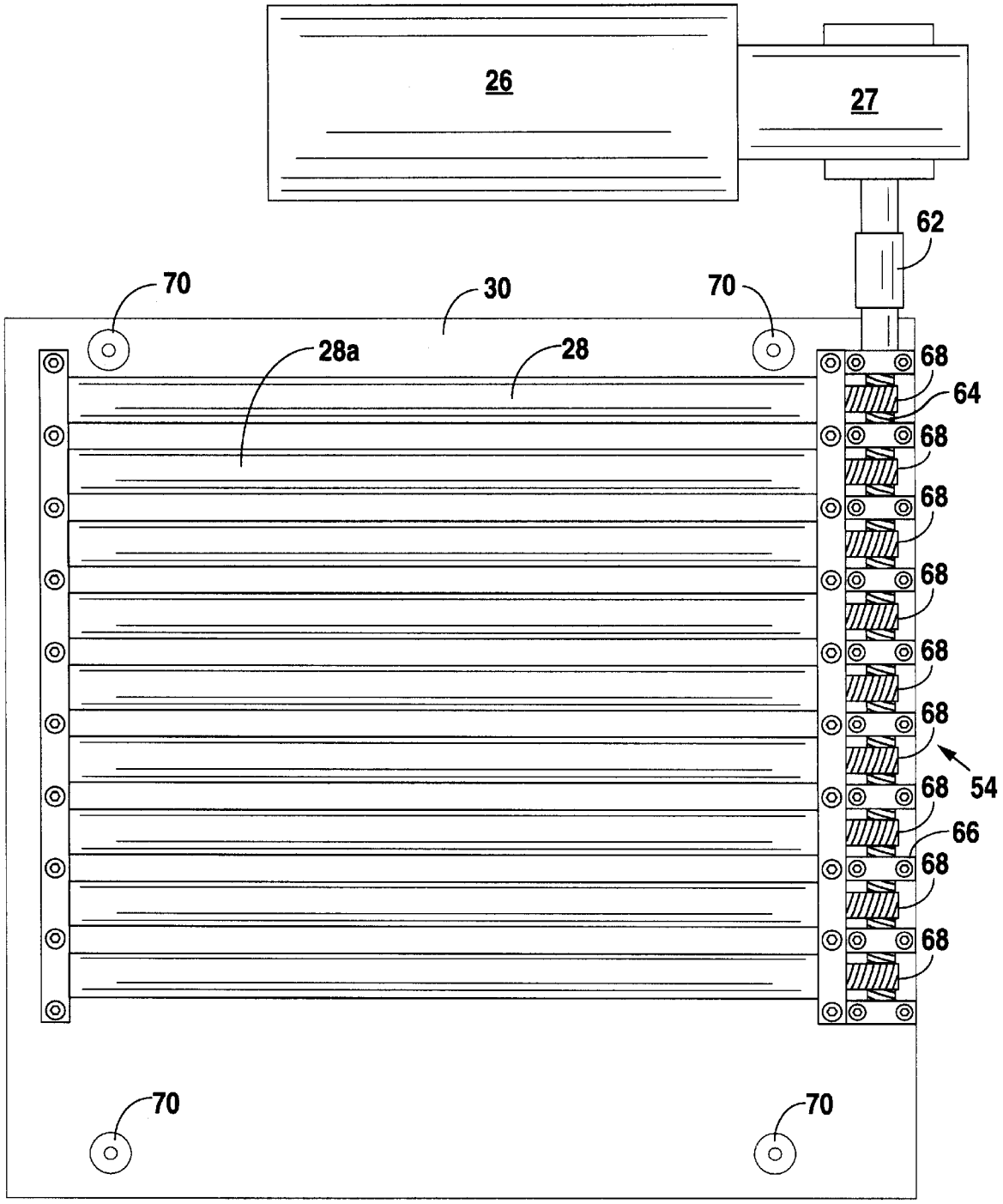
FIG. 3 shows a top view of the drive train of a seat support of the present invention.

Turning to FIG. 3, a top view of the drive train 54 of a seat support frame 14 is shown. The seat support frame 14 is mounted by fasteners 70 to the chair 10 and covered with cover 15. A second separate driver system 60 includes a motor 26, a gearbox 27, a drive coupling 62, and helical worm gear shaft 64. The shaft 64 is supported by bearing 66 on the side of second support frame 30.

The motor 26 of the second driver system 60 may be operated independently of the motor 22 of the first driver system 21 although the same controls 24 activate each system. The motor speed and direction may be varied by the controls 24 and are powered by a typical power source such as a d.c. battery, a.c. power, gas or solar energy system.

Second support frame 30 holds a plurality of generally cylindrical rollers 28 and 28*a* extending transversely across substantially the entire width of second support frame 30 and arranged in substantially parallel relationship. It will be noted that rollers 28 and 28*a* do not require a central, circumferential depression. However, in some embodiments of the invention such depressions may be useful to reduce central roller contact with body in or on the support device.

Figure 4B:
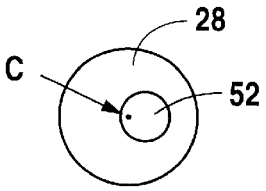
FIG. 4B illustrates the eccentric journaling of a roller of the present invention.
Figure 4A:
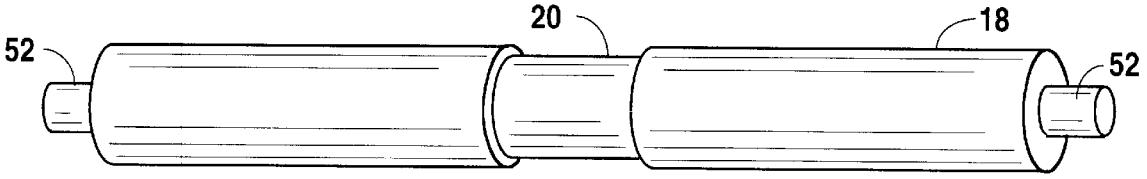
FIG. 4A illustrates a roller of the present invention having a central, circumferential depression in the surface of the roller.

As with the rollers 18 and 18*a* in the first support frame 16, rollers 28 and 28*a* have end journals 52 which are offset from the symmetrical center C of the roller (see FIG. 4B). Thus, the rollers 28 and 28*a* in the second support frame raise and lower urging against the body on or in the support device when rotated by the motor 26. By adjusting the degree of rotation of the helical drive gears 68 on the end of journal 52 during the setup of the drive train 54, it will be understood that the timing of the pattern of raising and lowering may be varied on each roller 28 and 28*a*. Further, the direction and rate of rotation may be varied either through the gearing or motor speed and direction.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

I claim:

1. A massaging support device for a body comprising: first support frame attached to a support member;

plurality of first rollers extending transversely across said first support frame and arranged in substantially parallel relationship, each of said first rollers further comprising:

an eccentric journal about which each of said first rollers may rotate and a central circumferential depression in the surface of each of said first rollers;

first drive gears attached to each said eccentric journal;

first driver connected to said first drive gears to power the rotation of said first rollers in a first rotational direction at a first rotational rate;

second support frame spaced apart from said first support frame and attached to said support member;

plurality of second rollers extending transversely across said second support frame and arranged in substantially parallel relationship, each of said second rollers further comprising:

an eccentric journal about which each of said second rollers rotate with second drive gears attached to each eccentric journal; and a second driver connected to said second gears to power the rotation of said second rollers in a second rotational direction at a second rotational rate, said first rotational direction and said second rotational direction are opposite.

2. The device of claim 1 wherein said first rotational rate is different than said second rotational rate.

3. The device of claim 1 wherein the timing of said first and said second gears is arranged to rotate said first and said second rollers in a predetermined pattern.

4. The device of claim 1 wherein said central circumferential depression in each of said first rollers is approximately 1" to 3" wide.

5. A massaging support chair for a body comprising:

first support frame attached to a support member;

plurality of first rollers extending transversely across said first support frame and arranged in substantially parallel relationship, each of said first rollers further comprising:

an eccentric journal about which each of said first rollers may rotate and a central circumferential depression in the surface of each of said first rollers;

first drive gears attached to each said eccentric journal;

first driver connected to said first drive gears to power the rotation of said first rollers in a first rotational direction at a first rotational rate;

second support frame spaced apart from said first support frame and attached to said support member;

plurality of second rollers extending transversely across said second support frame and arranged in substantially parallel relationship, each of said second rollers further comprising:

an eccentric journal about which each of said second rollers rotate with second drive gears attached to each eccentric journal; and a second driver connected to said second gears to power the rotation of said second rollers in a second rotational direction at a second rotational rate;

said first frame is a back support arranged at a vertical angle greater than 0° and less than 90° to said second frame which is a seat support; said back support and said seat support cradling the body in said chair, said first rotational direction urging the body toward said seat support and said second rotational direction urging the body toward said back support; said first rotational rate different than said second rotational rate, said central circumferential depression in each of said first rollers aligned with the spine of the body.

* * * * *